US008177264B2

(12) United States Patent
Iwakami

(10) Patent No.: US 8,177,264 B2
(45) Date of Patent: May 15, 2012

(54) ARTICLE STORING STRUCTURE FOR SMALL BOAT

(75) Inventor: Hiroshi Iwakami, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 918 days.

(21) Appl. No.: 11/902,893

(22) Filed: Sep. 26, 2007

(65) Prior Publication Data

US 2008/0178787 A1 Jul. 31, 2008

(30) Foreign Application Priority Data

Sep. 29, 2006 (JP) ..... 2006-268619

(51) Int. Cl.
*E05C 9/16* (2006.01)

(52) U.S. Cl. ..... 292/36; 292/DIG. 5; 292/DIG. 11; 292/DIG. 43

(58) Field of Classification Search ..... 292/7, 30–35, 292/41, 46, 53, 156, 157–158, 167–168, 292/138–139, 146, 150, 277, 302, DIG. 12, 292/DIG. 17, DIG. 5, DIG. 11, DIG. 43, 292/DIG. 42
See application file for complete search history.

(56) References Cited

U.S. PATENT DOCUMENTS

| | | | | |
|---|---|---|---|---|
| 726,577 | A * | 4/1903 | Schiek | 16/229 |
| 4,594,750 | A * | 6/1986 | Carcas | 16/229 |
| 4,997,218 | A * | 3/1991 | Culling | 292/60 |
| 5,187,836 | A * | 2/1993 | Kim et al. | 16/231 |
| 5,561,995 | A * | 10/1996 | Copping et al. | 70/120 |
| 5,593,330 | A | 1/1997 | Kobayashi | |
| 5,829,197 | A * | 11/1998 | Oh | 49/193 |
| 6,669,243 | B2 * | 12/2003 | Katoh et al. | 292/34 |
| 7,204,527 | B2 * | 4/2007 | Geurden | 292/122 |
| 2005/0204996 | A1 | 9/2005 | Hirabara | |

FOREIGN PATENT DOCUMENTS

| | | | |
|---|---|---|---|
| JP | 2-77570 | U | 6/1990 |
| JP | 2000-54705 | A | 2/2000 |
| JP | 2003-072678 | A | 3/2003 |
| JP | 2005-263135 | A | 9/2005 |
| JP | 2007-261545 | A | 10/2007 |

* cited by examiner

*Primary Examiner* — Thomas A Beach
*Assistant Examiner* — Mark Williams
(74) *Attorney, Agent, or Firm* — Birch, Stewart, Kolasch & Birch, LLP

(57) ABSTRACT

An article storing structure for a small boat capable of easily carrying out the opening operation of a lid without spending time and effort and capable of easily taking luggage in and out. The article storing structure includes an article storing box for storing luggage in the hull and a lid covering an opening of the article storing box from above. The article storing structure includes left and right hinges provided at the left and right sides of the lid, respectively, for supporting the lid so as to be freely opened and closed and left and right lock members provided at the left and right sides of the lid, respectively, and capable of releasing the left and right hinges in the engaged condition, respectively. By releasing one of the left and right hinges in the engaged condition by the lock member, the lid can be opened and closed laterally.

17 Claims, 14 Drawing Sheets

ARTICLE STORING STRUCTURE FOR SMALL BOAT

CROSS-REFERENCE TO RELATED APPLICATIONS

The present application claims priority under 35 USC 119 to Japanese Patent Application No. 2006-268619 filed on Sep. 29, 2006 the entire contents of which are hereby incorporated by reference.

BACKGROUND OF THE INVENTION

1. Field of the Invention

The present invention relates to article storing structures for a small boat including an article storing box for storing luggage in a hull with a lid body covering an opening of this article storing box from above.

2. Description of Background Art

Some small boats include an article storing box forward of the hull and a hood (lid) above the article storing box so as to be freely opened and closed. A front end part of this lid is connected to the main body via a hinge so as to be freely opened and closed, and a lock member is provided at a rear end part of the lid body. See, for example, Japanese Patent Application Laid-open Publication No. 2003-72678.

When opening the lid according to Japanese Patent Application Laid-open Publication No. 2003-72678, a locked state is released by operating the lock member of the rear end part, and then the rear end part is lifted upwardly about the hinge of the front end part.

The lid swings upward about the hinge, so that an opening of the article storing box opens. By opening the opening of the article storing box, it is possible to store luggage in the article storing box or to remove luggage therefrom.

When storing luggage in the article storing box or removing luggage from the article storing box, it is conceivable that the lid disposed above the opening gets in the way during the storing and removing operations of the luggage.

In order to prevent the lid from getting in the way during the storing and removing operations of the luggage, the lid needs to be opened sufficiently wide.

However, the lid is a member elongating in the front-rear direction of the hull. Accordingly, in order to open the opening of the article storing box in such a manner that the lid will not get in the way, the rear end part of the lid needs to be lifted upwardly high.

For this reason, the opening operation of the lid needs time and effort. Thus, there remains a room for improvement in this regard.

SUMMARY AND OBJECTS OF THE INVENTION

The present invention is intended to provide an article storing structure for a small boat capable of easily carrying out the opening operation of a lid without spending time and effort and also capable of easily taking luggage in and out.

A first aspect of the present invention provides an article storing structure for a small boat that includes an article storing box for storing luggage in the hull and a lid covering an opening of the article storing box from above. The article storing structure for the small boat also includes a pair of hinges which are provided at the left and right sides of the lid, respectively, and which support the lid so as to be opened and closed freely; and a pair of lock members provided at the left and right sides of the lid, respectively, and capable of releasing the pair of hinges in the engaged condition, respectively. In the article storing structure for the small boat with the above configuration, the lid is constructed so as to be opened and closed freely laterally by releasing one of the pair of hinges in the engaged condition with the lock member.

The lid is a member which elongates in the front-rear direction of the hull, and which is formed to have a large length dimension and a small width dimension.

Moreover, because a small boat is brought alongside the quay, it is preferable to prevent the lid from getting in the way when taking luggage in and out from the side of the small boat.

For this reason, according to an embodiment of the present invention the hinge and the lock member are provided at each of the left and right sides of the lid. By releasing one of the left and right hinges in the engaged condition by the lock member, the lid can be opened and closed laterally.

According to an embodiment of the present invention, an article storing structure for a small boat is provided wherein a hinge includes a pin provided in one of the hull and the lid, and a support member which is provided in the other one of the hull and the lid for supporting the pin so as to be freely rotatable. The article storing structure for the small boat also includes the lock member which has an operating part that operates the pin and the support member so as to be freely engaged and disengaged. In the article storing structure for the small boat with the above configuration, by operating the pin and the support member of one of the pair of hinges into a disengaged state with the operating part, the lid is formed to swing about the other hinge.

According to an embodiment of the present invention, operating parts are provided at the left and right sides of the lid, respectively. The left side hinge is operated so as to be engaged and disengaged freely with the left side operating part, and the right side hinge is operated so as to be engaged and disengaged freely with the right side operating part.

According to an embodiment of the present invention, an article storing structure for a small boat includes an article storing box for storing luggage in a hull and a lid for covering an opening in the article storing box from above. The article storing structure for the small boat also includes a hinge which is provided at one end of the left and right ends of the lid for supporting the lid so as to be opened and closed freely; and a lock member which is provided at the other end of the left and right ends of the lid for allowing for the connection and disconnection of the lid. In the article storing structure for the small boat with the above configuration, the lid is constructed so as to be freely opened and closed laterally by releasing the lid in the engaged condition by the lock member.

According to an embodiment of the present invention, the lid is allowed to be opened and closed laterally by releasing one of the left and right hinges in the engaged condition by the lock member.

Because the width dimension of the lid is small, by opening the lid laterally (laterally opening), the amount of lifting the lid can be reduced.

This provides an advantage in that the opening operation of the lid can be carried out more easily without spending time and effort.

Moreover, by opening the lid laterally (laterally opening), the hinge does not need to be provided forward of the opening of the article storing box.

This allows the dimension of the opening to be widened, and allows a large storage space of the article storing box to be secured to provide an advantage in that taking luggage in and out can be easily carried out.

In addition, by allowing the lid to be opened and closed in the width direction (laterally) of a small dimension, a force acting on the hinge and a force of lifting the lid can be reduced when the lid is opened.

This provides an advantage in that the hinge or the assist mechanism can be reduced in size.

It should be noted that the assist mechanism is served to balance out the weight of the lid when opening it.

Furthermore, in the state wherein a small boat is brought alongside the quay, the laterally opened lid is disposed opposite to the quay.

Accordingly, the lid will not get in the way when taking luggage in and out from the quay side, thus providing an advantage in that taking luggage in and out can be easily carried out.

In addition, by providing the lock member and the hinge at the left and right sides of the lid, the lid can be opened from the left and right sides of the hull.

Accordingly, when the left side of a small boat comes alongside the quay, the left side of the lid can be opened, and when the right side of a small boat comes alongside the quay, the right side of the lid can be opened.

This makes it possible that, even when either side of the left and right sides of a small boat comes alongside the quay, the lid can be easily opened from the quay side, thus providing an advantage that usability of the lid can be improved.

According to an embodiment of the present invention, by operating one of the hinges into a disengaged state with the operating part, the lid can be swung about the other hinge.

Using the hinge as a part of the lock member has an advantage of reducing the number of components, and simplifying and downsizing the structure.

According to an embodiment of the present invention, the operating part is provided at the left and right sides of the lid. Then, the left side hinge is operated so as to be engaged and disengaged freely with the left side operating part, and the right side hinge is operated so as to be engaged and disengaged freely with the right side operating part.

Accordingly, by operating the operating part at the side of the lid to open, the hinge at the side to open can be disengaged.

This allows the operating part to be operated easily and allows the lid to be easily opened, thus providing an advantage that usability can be further improved.

According to an embodiment of the present invention, the hinge is provided at one end of the left and right sides of the lid, and a lock member is provided at the other end of the left and right sides of the lid, so that the lid can be opened and closed laterally about the hinge by releasing the lock member.

This provides an advantage wherein the same effect as that of the first aspect can be obtained.

In addition, by setting the hinge to be a dedicated component, not to be a component serving as the lock member, the hinge can be provided in a place (e.g., at a corner of the lid) optimum for the hinge to serves as a hinge.

This allows the lid to be supported more comfortably with the hinge, thus providing an advantage wherein the rigidity of the lid can be improved further when opening the lid.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Hereinafter, the description for implementing the preferred embodiments of the present invention will be given with reference to the accompanying drawings. It should be noted that the terms "front," "rear," "left," "right," "upper," and "lower" represent the direction viewed from the driver, and that the front side, the rear side, the left side, and the right side are expressed as Fr, Rr, L, and R, respectively.

Figure 1:
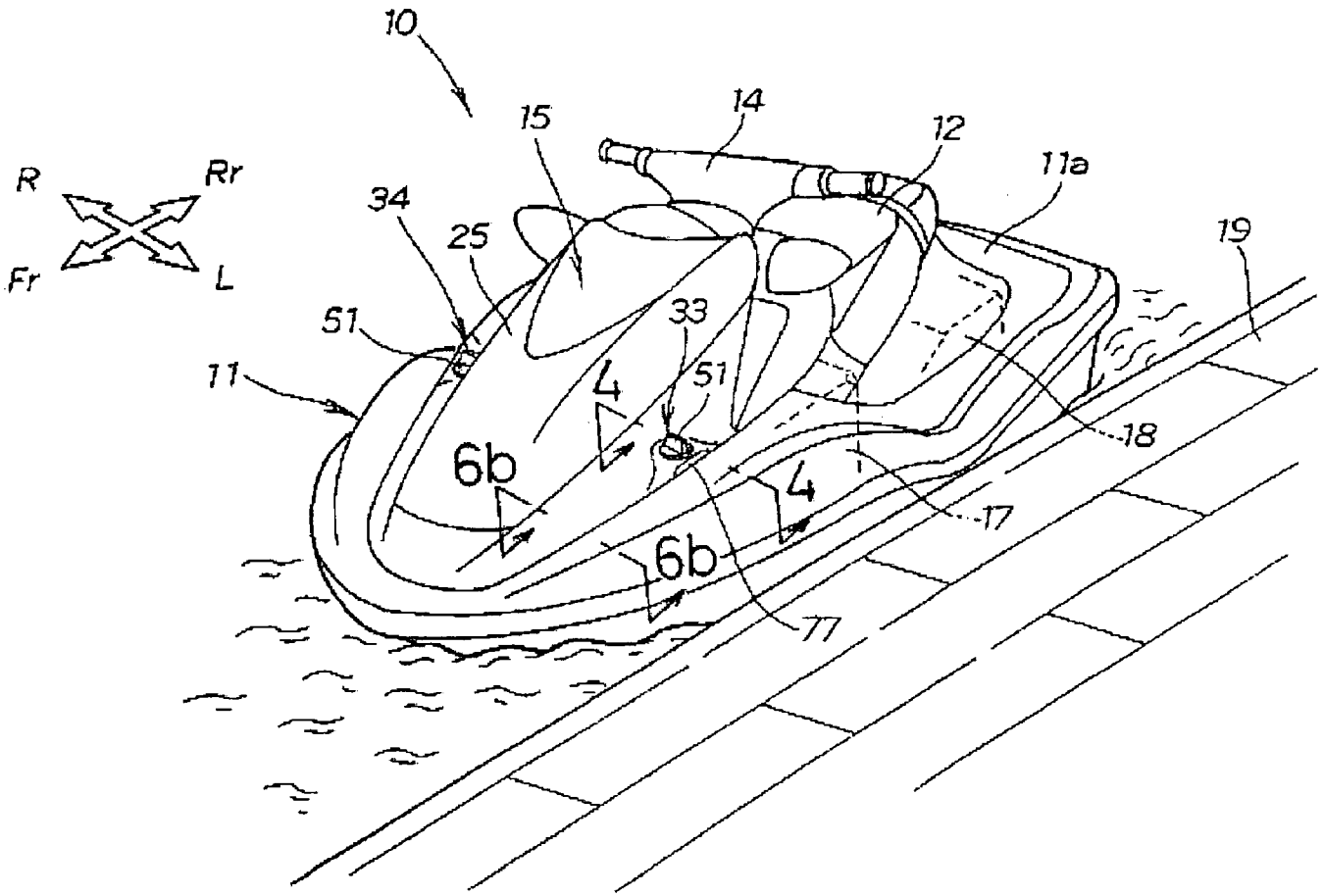
FIG. 1 is a perspective view showing a small boat provided with an article storing structure (a first embodiment) for a small boat according to the present invention.

FIG. 1 is a perspective view showing a small boat provided with an article storing structure (a first embodiment) of a small boat according to the present invention.

A small boat 10 includes a seat 12 provided in the front-rear direction in the substantially rear half of a hull 11, a steering handle 14 provided forward of the seat 12 and on the center line in the width direction of the hull 11, an article storing structure (article storing structure for the small boat) 15 for storing luggage provided forward of the steering handle 14, an engine 17 provided inside the hull 11 and a water jet pump 18 provided at the rear of the engine 17.

When propelling (sliding) the small boat 10, the water jet pump 18 is driven by the engine 17 to thereby suck water from an inlet port in the vessel bottom and then splash the sucked water rearwardly from a rear part of the boat 11*a*. Splashing the sucked water rearwardly from the rear part of the boat 11 propels (slides) the small boat 10.

When bringing this small boat 10 to a quay 19, the small boat 10 is brought alongside the quay 19.

Figure 2:
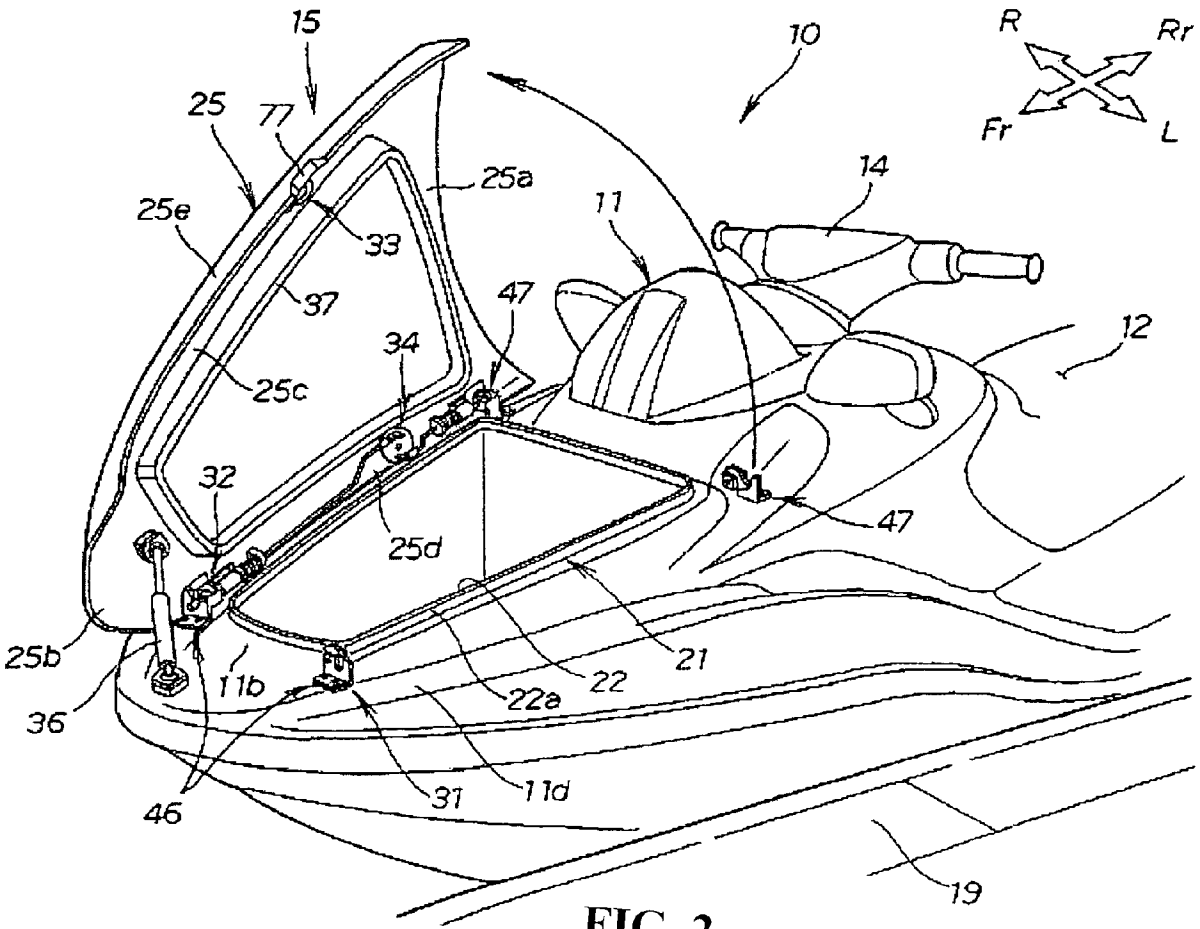
FIG. 2 is a perspective view showing a state in which a lid of the article storing structure according to the first embodiment is opened.

FIG. 2 is a perspective view showing a state in which a lid of the article storing structure according to the first embodiment is opened.

The article storing structure 15 of a small boat includes an article storing box 21 for storing luggage provided in the front portion of the hull 11 and forward of the steering handle 14, a lid 25 for covering, above an opening 22 of the article storing box 21, the opening 22, left and right hinges (a pair of hinges) 31, 32 which support the lid 25 so as to be freely opened and closed; left and right lock members (a pair of lock members) 33, 34 capable of releasing the left and right hinges 31, 32 in the engaged condition, respectively; and an assist mechanism (e.g., gas stay bolt) 36 which is connected to the lid 25 and to the hull 11, and which balances out the weight of the lid 25.

The left hinge 31 is provided at the left side of the lid 25, and the right hinge 32 is provided at the right side of the lid 25.

Moreover, the left lock member 33 is provided at the left side of the lid 25, and the right lock member 34 is provided at the right side of the lid 25.

The article storing box 21 is housed in the hull 11. The opening 22 is opened in a surface 11*b* of the hull 11, and luggage is taken in and out of the opening 22.

The opening 22 is formed in a substantially rectangular shape, and a periphery 22*a* thereof is formed to project.

The lid 25 is formed in a tapered shape so that the width thereof may become gradually narrow from a rear end part 25*a* towards a front end part 25*b*. The rear end part 25*a* is formed into a concave curve, and the front end part 25*b* is formed into a convex curve. A seal part 37 is provided on a back surface 25*c*.

The seal part 37 seals the periphery 22*a* of the opening 22 when the lid 25 is in the closed state. Accordingly, the opening 22 can be sealed with the lid 25 when the lid 25 is in the closed state.

The left and right hinges 31, 32 are bilaterally symmetric, and the description will be given by using the same reference numerals to each constituting member of the left and right hinges 31, 32.

The left and right lock members 33, 34 are bilaterally-symmetric members, and the description will be given by using the same reference numerals to each constituting member of the left and right lock members 33, 34.

Figure 3:
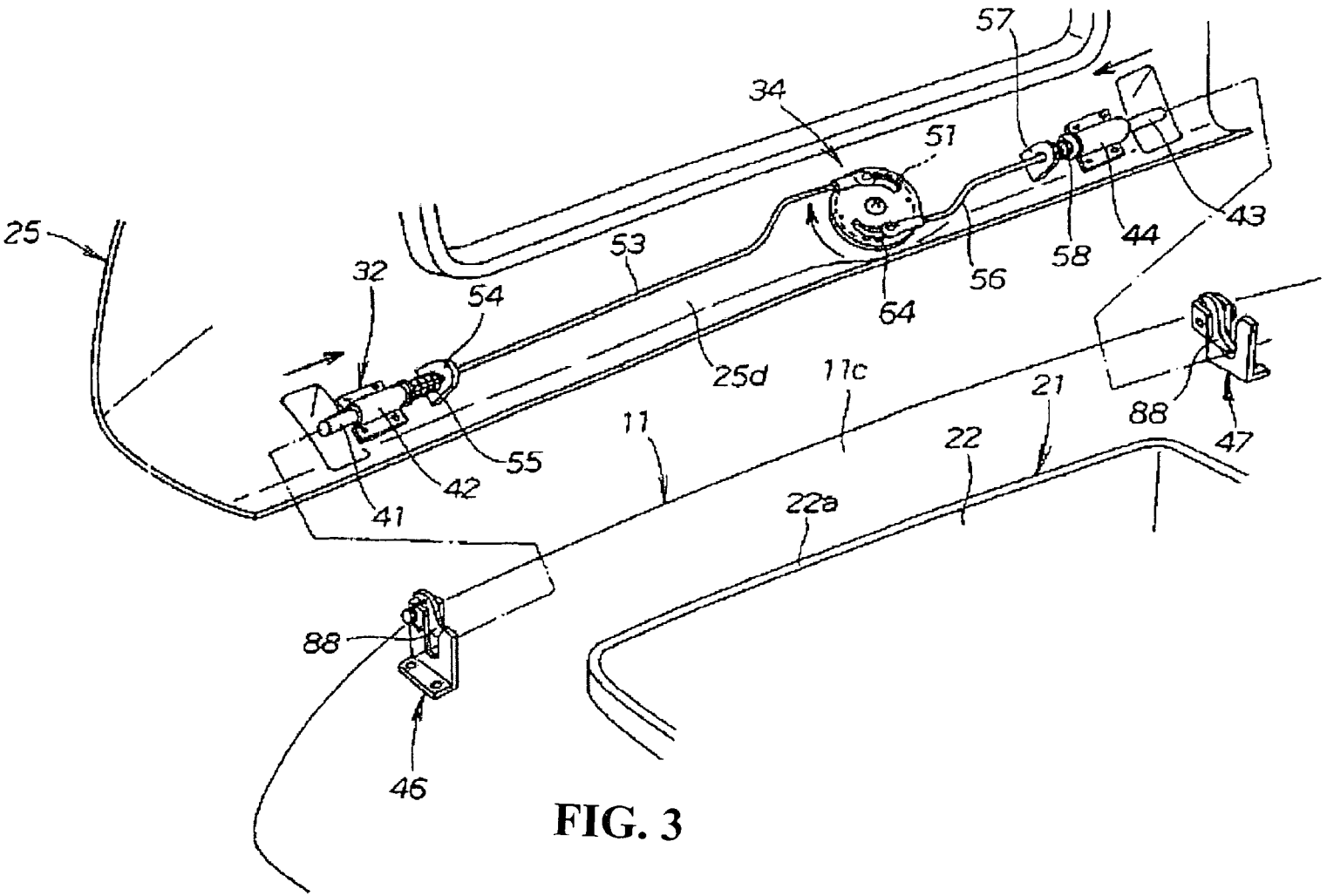
FIG. 3 is a perspective view showing a state in which the lid of the article storing structure according to the first embodiment is removed.

FIG. 3 is a perspective view showing a state in which the lid of the article storing structure according to the first embodiment is removed.

For the right hinge 32 in a right side portion 25*d* of the lid 25 a front pin (pin) 41 is provided on the front side back surface with a front mounting member 42, a rear pin (pin) 43 is provided on the rear side back surface with a rear mounting member 44, in a right side portion 11*c* of the hull 11, a front supporting member (supporting member) 46 is provided forward of the opening 22 and a rear supporting member (supporting member) 47 is provided at the back of the opening 22.

The front pin 41 is rotatably supported by a front supporting member 46, and the rear pin 43 is rotatably supported by a rear supporting member 47. Accordingly, the right side portion 25*d* of the lid 25 is connected to the right side portion 11*c* of the hull 11 so as to swing freely via the right hinge 32.

This allows the lid 25 to be opened and closed laterally about the right hinge 32.

The front pin 41 is disposed facing the front-rear direction of the hull 11 and is movably provided in the front-rear direction with the front mounting member 42.

The front supporting member 46 is a member for rotatably supporting the front pin 41.

The rear pin 43 is disposed facing the front-rear direction of the hull 11 and is provided moveably in the front-rear direction with the rear mounting member 44.

The rear supporting member 47 is a member for rotatably supporting the rear pin 43.

The right lock member 34 includes an operating part 51 provided in the right side portion 25*d* of the lid 25 and between the front and rear pins 41, 43, a front connecting rod 53 for connecting the front pin 41 to the operating part 51, a front supporting bracket 54 for supporting the front connecting rod 53, a front compression spring 55 for holding the front pin 41 in a hinge position, a rear connecting rod 56 for connecting the rear pin 43 to the operating part 51, a rear supporting bracket 57 for supporting the rear connecting rod 56 and a rear compression spring 58 for holding the rear pin 43 in a hinge position.

The operating part 51 is a member which is rotatably provided in the right side portion 25*d* of the lid 25, and which operates the front pin 41 so as to be freely connected and disconnected to the front supporting member 46, and at the same time operates the rear pin 43 so as to be connected and disconnected freely to the rear supporting member 47.

More specifically, the operating part 51 is operated to rotate as indicated by the arrow, so that the front and rear pins 41, 43 are moved toward the operating part 51 via the front and rear connecting rods 53, 56 as indicated by the arrow.

Due to the movement of the front and rear pins 41, 43 as indicated by the arrow, the front pin 41 disengages from the front supporting member 46, and the rear pin 43 disengages from the rear supporting member 47.

On the other hand, by releasing the operating force from the operating part 51, a spring force of the front compression spring 55 moves the front pin 41 toward the front supporting member 46, and at the same time a spring force of the rear compression spring 58 moves the rear pin 43 toward the rear supporting member 47.

Due to the movement of the front pin 41 toward the front supporting member 46, the front pin 41 is engaged (connected) with the front supporting member 46. Moreover, due to the movement of the rear pin 43 toward rear supporting member 46, the rear pin 43 is engaged (connected) with the rear supporting member 47.

In other words, by operating the right hinge 32 into the disengaged state with the operating part 51, the lid 25 can swing about the left hinge 31 (see FIG. 2 and FIG. 5) to be opened and closed.

Accordingly, the right hinge 32 can be served also as a part of the right lock member 34.

Similarly, the left hinge 31 can be served also as a part of the left lock member 33.

Figure 4:
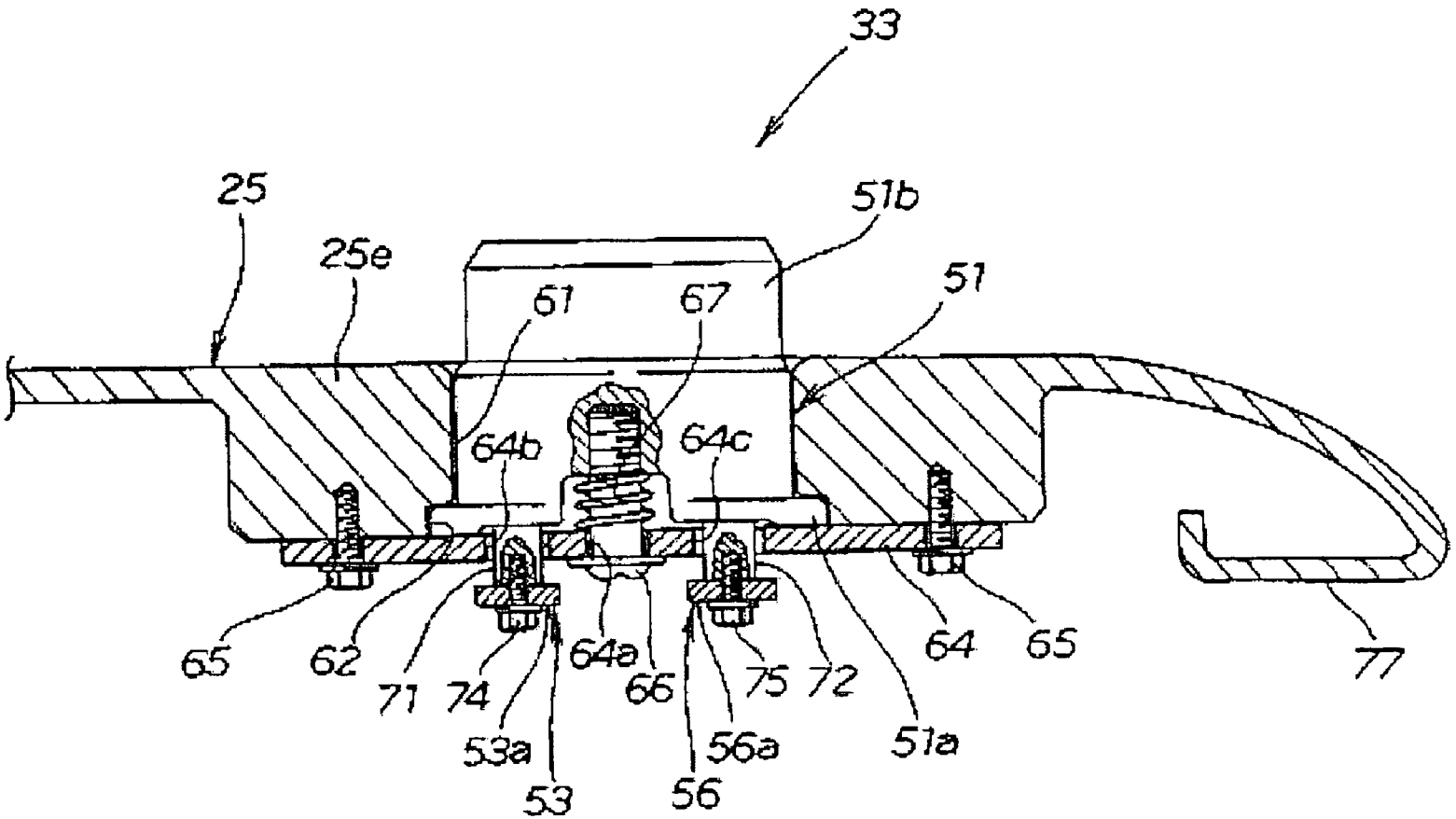
FIG. 4 is a cross sectional view taken along the line 4-4 of FIG. 1.

FIG. 4 is a cross-sectional view taken along the line 4-4 of FIG. 1.

The operating part 51 of the left lock member 33 is rotatably attached to a left side portion 25*e* of the lid 25.

In other words, a housing hole 61 is formed in the left side portion 25*e* of the lid 25, and a step 62 is formed in the lower end portion of the housing hole 61. The operating part 51 is housed in the housing hole 61, and a flange 51*a* of the operating part 51 is disposed at the step 62.

A cover 64 is attached to the back surface of the left side portion 25*e* with a bolt 65, and a screw 66 inserted from a central hole 64*a* of the cover 64 is thread connected on the axis of the operating part 51.

Accordingly, by gripping and operating a gripping part 51*b* of the operating part 51, the operating part 51 can be rotated about the screw 66 into a locked position and into an unlocked position.

Here, the locked position is a position for engaging (connecting) the front pin 41 with the front supporting member 46 and for engaging (connecting) the rear pin 43 with the rear supporting member 47.

The unlocked position is a position for disengaging the front pin 41 from the front supporting member 46 and for disengaging the rear pin 43 from the rear supporting member 47.

A return spring 67 is fitted into the screw 66. The return spring 67 is disposed between the operating part 51 and the cover 64. One end part 67*a* (see FIG. 5) is engaged with the operating part 51, and other end 67*b* (see FIG. 5) is engaged with the cover 64.

The operating part 51 is held in the locked position by a spring force of the return spring 67.

Figure 5:
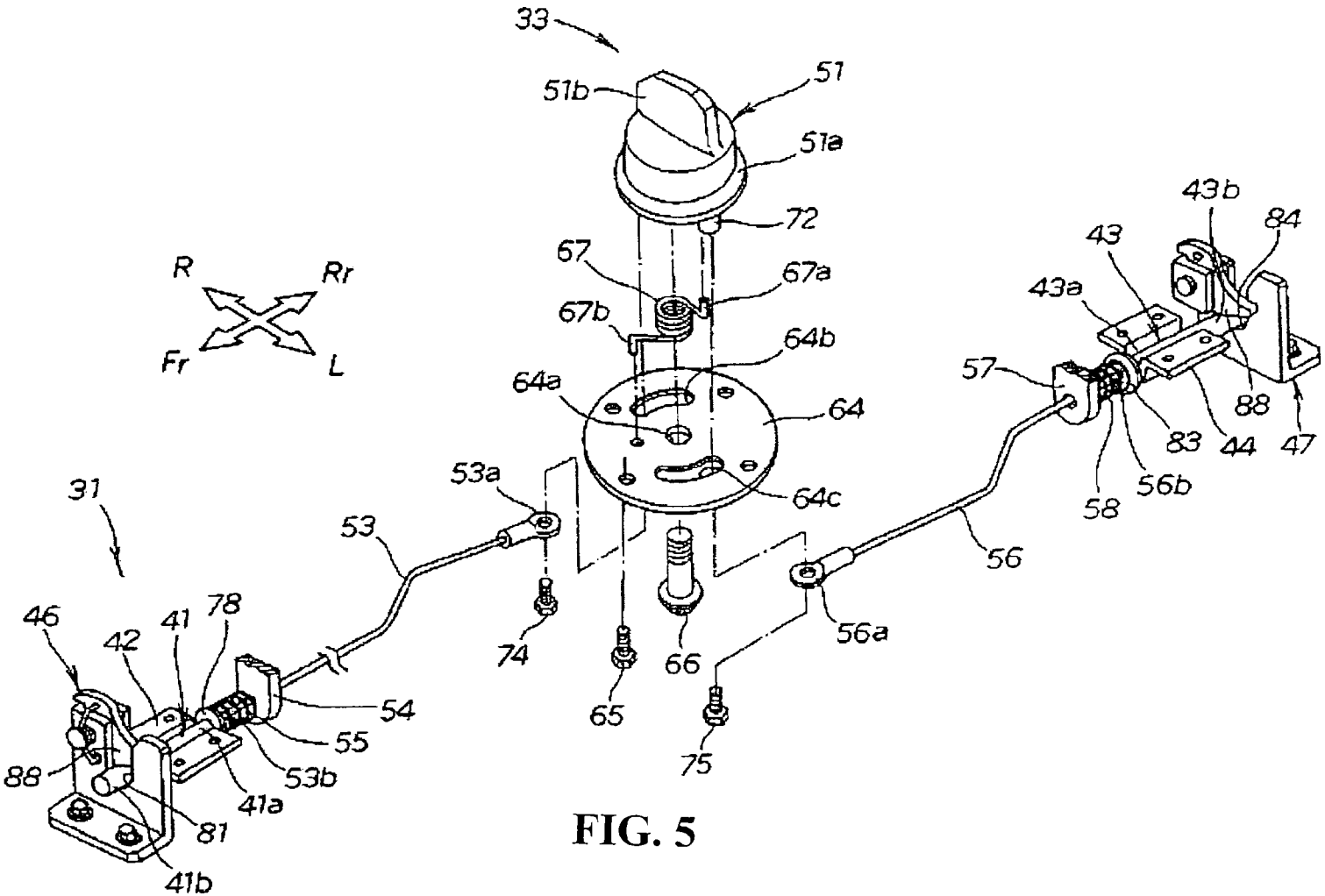
FIG. 5 is an exploded perspective view showing a left hinge and a left lock member according to the first embodiment.

In the operating part 51, inner and outer projections 71, 72 are formed therein. The inner projection 71 projects downwardly through an inner guide hole 64*b* of the cover 64. The inner guide hole 64*b* is formed in an arc shape as shown in FIG. 5.

A rear end part 53*a* of the front connecting rod 53 is connected to a lower end portion of the inner projection 71 via a bolt 74.

The outer projection 72 projects downwardly through an outer guide hole 64*c* of the cover 64. The outer guide hole 64*c* is formed in an arc shape as shown in FIG. 5.

A front end part 56*a* of the rear connecting rod 56 is connected to a lower end portion of the outer projection 72 via a bolt 75.

In the left side portion 25*e* of the lid 25, provided is a handle 77 (see FIG. 1, too) on which a user puts his/her hand when opening the lid 25.

The handle 77 is disposed in the vicinity of the operating part 51. Accordingly, a user can easily puts his/her hand on the handle 77 when operating the operating part 51.

In addition, the handle 77 is also formed in the right side portion 25*d* of the lid 25 in the same manner.

FIG. 5 is an exploded perspective view showing the left hinge and the left lock member according to the first embodiment.

For the front connecting rod 53, a front end part 53*b* extends forward through a through-hole of the front supporting bracket 54 and is connected to a base end 41*a* of the front pin 41.

The front pin 41 is disposed facing the front-rear direction of the hull 11 (see FIG. 2), and a projecting part 78 is formed in the base end 41*a*. This front pin 41 is movably provided in the front-rear direction with the front mounting member 42.

The front compression spring 55 is disposed between the projecting part 78 of the front pin 41 and the front supporting bracket 54. The projecting part 78 is held in contact with the front mounting member 42 by a spring force of the front compression spring 55.

Under this state, a tip part 41*b* of the front pin 41 is held in a state projecting from the front mounting member 42.

The tip part 41*b* projecting from the front mounting member 42 is held rotatably in a front engagement groove 81 of the front supporting member 46.

The front supporting member 46 will be described in detail in FIG. 6.

On the other hand, in the rear connecting rod 56, a rear end part 56*b* extends rearwardly through a through-hole of a rear supporting bracket 57 and is connected to a base end 43*a* of the rear pin 43.

The rear pin 43 is disposed toward the front-rear direction of the hull 11, and a projecting part 83 is formed in the base end 43*a*. This rear pin 43 is movably provided in the front-rear direction with the rear mounting member 44.

A rear compression spring 58 is disposed between the projecting part 83 of the rear pin 43 and the rear supporting bracket 57. The projecting part 83 is held in contact with the rear mounting member 44 by a spring force of the rear compression spring 58.

Under this state, a tip part 43*b* of the rear pin 43 is held in a state projecting from the rear mounting member 44.

The tip part 43*b* projecting from the rear mounting member 44 is held rotatably in a rear engagement groove 84 of the rear supporting member 47.

Figure 6A:
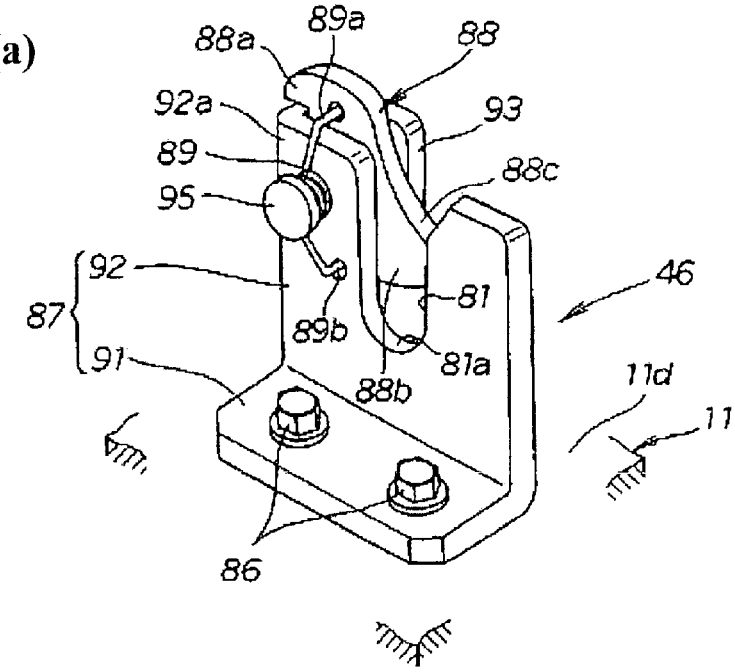
FIGS. 6(*a*) and 6(*b*) are views explaining the left hinge according to the first embodiment.
Figure 6B:
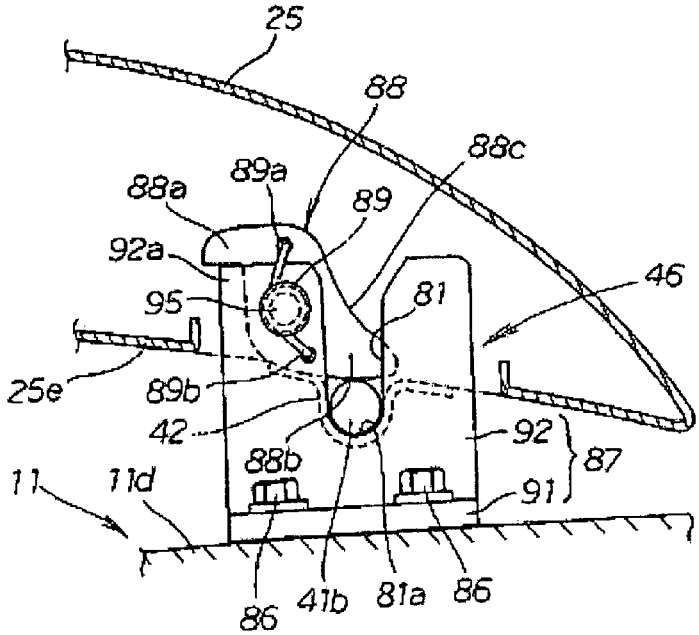

FIGS. 6 (*a*) and 6 (*b*) are views explaining the left hinge according to the first embodiment. FIG. 6 (*a*) is a perspective view showing the front supporting member 46, and FIG. 6 (*b*) is a cross sectional view taken along the line 6*b*-6*b* of FIG. 1.

The front supporting member 46 includes a supporting bracket 87 secured to the left side portion 11*d* of the hull 11 with bolts 86, 86, a lock piece 88 rotatably attached to the supporting bracket 87 and a spring member 89 for holding the lock piece 88 in a locked position.

The supporting bracket 87 is formed of a base 91 and a vertical part 92 in a substantially L-shape. The upstanding front engagement groove 81 is formed in the vertical part 92, and a bent piece 93 is provided in an inner side 92*a* of the vertical part 92.

The lock piece 88 is rotatably supported between the vertical part 92 and the bent piece 93 via a support pin 95. The spring member 89 is wound around the support pin 95 with one end part 89*a* of the spring member 89 engaged with the lock piece 88, and other end 89*b* of the spring member 89 engaged with the vertical part 92.

The lock piece 88 is biased counterclockwise by a spring force of the spring member 89. A projecting piece 88*a* of the lock piece 88 is in contact with the bent piece 93 to hold the lock piece 88 in the locked position.

Under this state, a claw part 88*b* of the lock piece 88 plugs the opening of the front engagement groove 81, and as shown in FIG. 6 (*b*) the tip part 41*b* of the front pin 41 is rotatably engaged (connected) with the front engagement groove 81.

On the other hand, in the state of FIG. 6 (*a*), by pressing an upper side 88*c* of the claw part 88*b* with the tip part 41*b* of the front pin 41, the lock piece 88 rotates clockwise against a spring force of the spring member 89.

The tip part 41*b* of the front pin 41 descends along the front engagement groove 81. When the tip part 41*b* of the front pin 41 reaches a bottom part 81*a* of the front engagement groove 81, the claw part 88*b* will disengage from the tip part 41*b* of the front pin 41.

The lock piece 88 rotates counterclockwise by a spring force of the spring member 89 and is held at a position of FIG. 6 (*b*). Accordingly, the tip part 41*b* of the front pin 41 is rotatably engaged (connected) with the front engagement groove 81.

Note that because the rear supporting member 47 is a member symmetrical with the front supporting member 46 front and rear, the description will be omitted by giving the same reference numerals to each constituting member thereof.

As described above, according to the article storing structure 15 for a small boat, the left and right hinges 31, 32 are provided in the lid 25.

By releasing one of the left and right hinges 31, 32 in the engaged condition with each of the lock members 33, 34, the lid 25 can be opened and closed in the lateral direction of the hull 11.

Accordingly, when the left side of the small boat 10 comes alongside the quay, the left side of the lid 25 can be opened, and when the right side of the small boat 10 comes alongside the quay, the right side of the lid 25 can be opened.

For this reason, even when either side of the left and right sides of the small boat 10 comes alongside the quay, the lid 25 can be easily opened from the quay 19 side.

Moreover, by operating one of the left and right hinges 31, 32 into a disengaged state with the operation part 51, the lid 25 can swing about the other hinge.

Accordingly, the left hinge 31 can be served also as a part of the left lock member 33, and the right hinge 32 can be served also as a part of the right lock member 34.

This allows the number of components of the article storing structure 15 to be reduced, and thus allows the structure to be simplified and downsized.

In addition, the operating parts 51 are provided at the left and right sides of the lid 25, respectively. Then, with the left side operation part 51, the left side hinge 31 is operated so as to be freely engaged and disengaged, and with the right side operation part 51, the right side hinge 32 is operated so as to be freely engaged and disengaged.

Accordingly, by operating the operation part 51 at the side of opening the lid 25, the hinges 31, 32 at the side to be opened can be disengaged.

This makes it possible for the operating part 51 to be operated easily, and for the lid 25 to be opened easily.

Next, an example of opening the left side of the lid 25 of the article storing structure 15 of a small boat is described in accordance with FIGS. 7 to 10.

Figure 7A:
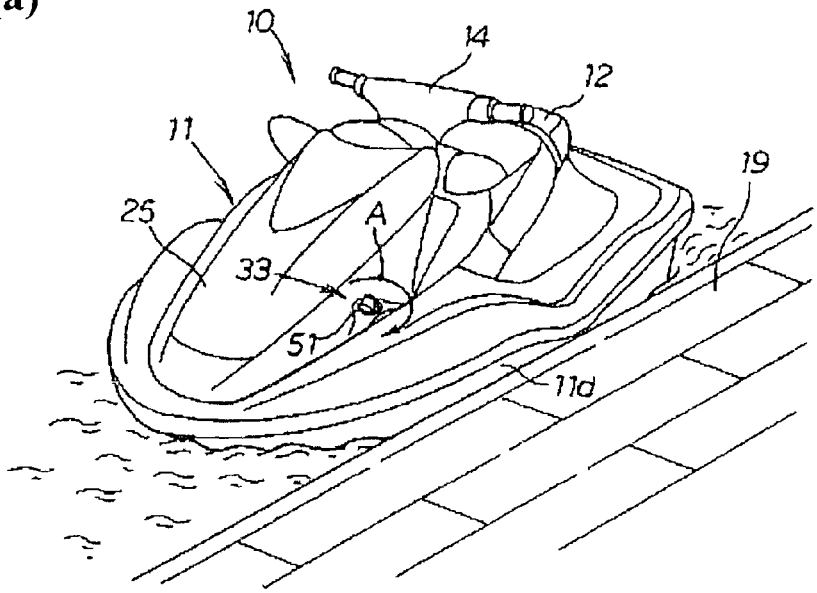
FIGS. 7(*a*) and 7(*b*) are views explaining an example of operating an operating part of the left side lock member according to the first embodiment.
Figure 7B:
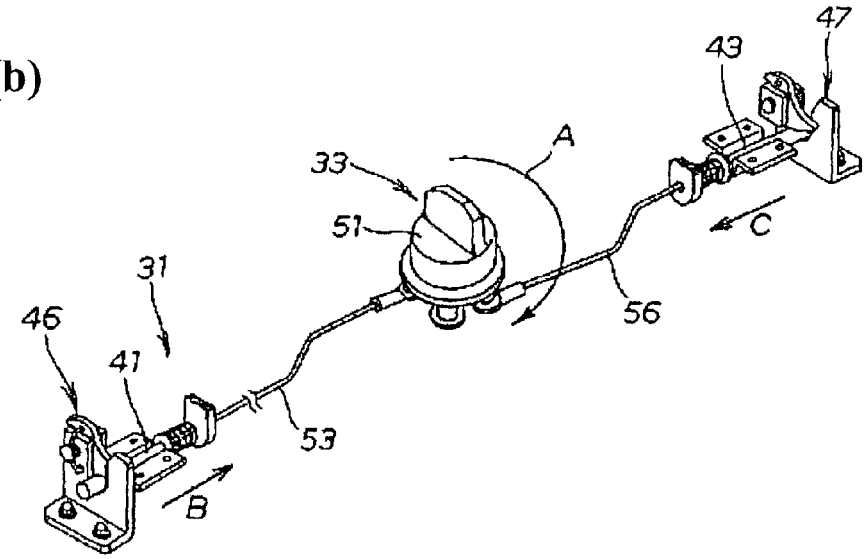

FIGS. 7(*a*) and 7(*b*) are views explaining an example of operating the operating part of the left lock member according to the first embodiment.

In FIG. 7(*a*), the small boat 10 is brought alongside the quay 19. The left side portion 11*d* of the hull 11 is in contact with the quay 19.

The operating part 51 of the left lock member 33 is operated from the quay 19 side as indicated by the arrow A.

The operating part 51 can be easily operated because the operating part 51 is positioned in the vicinity of the quay 19.

In FIG. 7(*b*), by operating the operating part 51 as indicated by the arrow A, the front pin 41 moves via the front connecting rod 53 as indicated by the arrow B.

In the same way, by operating the operating part 51 as indicated by the arrow A, the rear pin 43 moves via the rear connecting rod 56 as indicated by the arrow C.

Figure 8A:
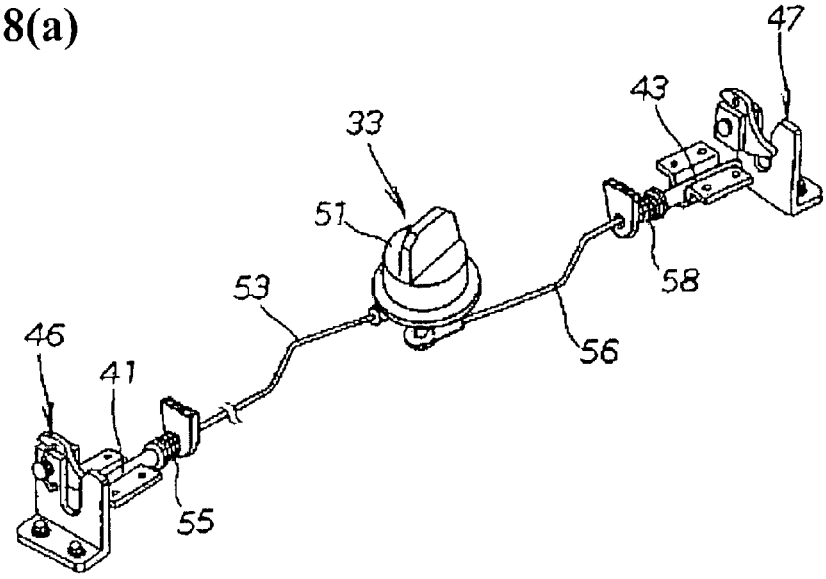
FIGS. 8(*a*) and 8(*b*) are views explaining an example of laterally opening the lid according to the first embodiment from the left side.
Figure 8B:
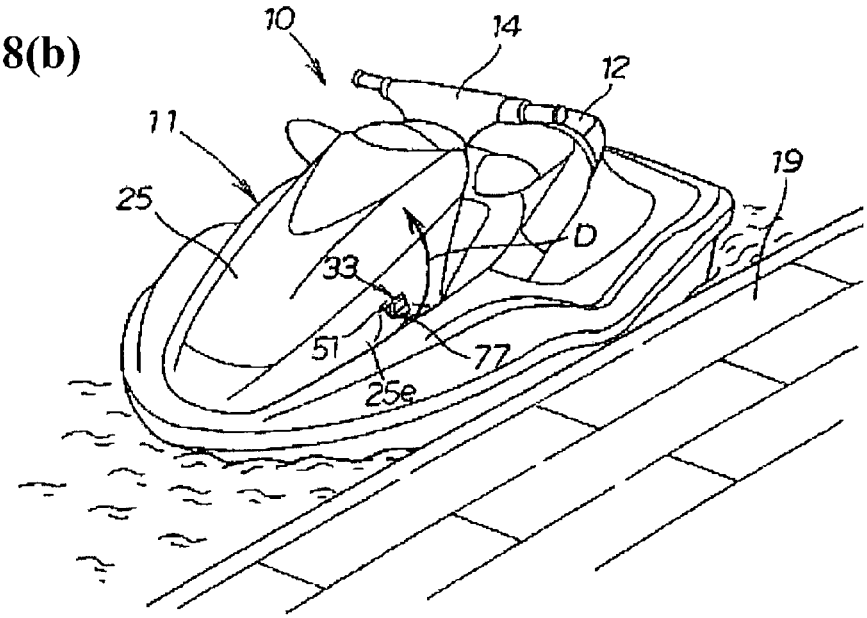

FIGS. 8(*a*) and 8(*b*) are views explaining an example in which the lid according to the first embodiment is laterally opened from the left side.

In FIG. 8(*a*), by rotating the operating part 51 to the unlocked position, the front pin 41 disengages from the front supporting member 46, and the rear pin 43 disengages from the rear supporting member 47.

In FIG. 8(*b*), a user grips the handle 77 formed in the left side portion 25*e* of the lid 25 and lifts the left side portion 25*e* of the lid 25 as indicated by the arrow D.

By slightly lifting the left side portion 25*e* of the lid 25, the front pin 41 shown in FIG. 8(*a*) moves upwardly of the front supporting member 46, and the rear pin 43 moves upwardly of the rear supporting member 47. With this state, the operating force is released from the operating part 51.

By releasing the operating force of the operating part 51, the front pin 41 returns to the state before the operation by a spring force of the front compression spring 55 shown in FIG. 8(*a*), and the rear pin 43 returns to the state before the operation by a spring force of the rear compression spring 58 shown in FIG. 8(*a*).

Figure 9:
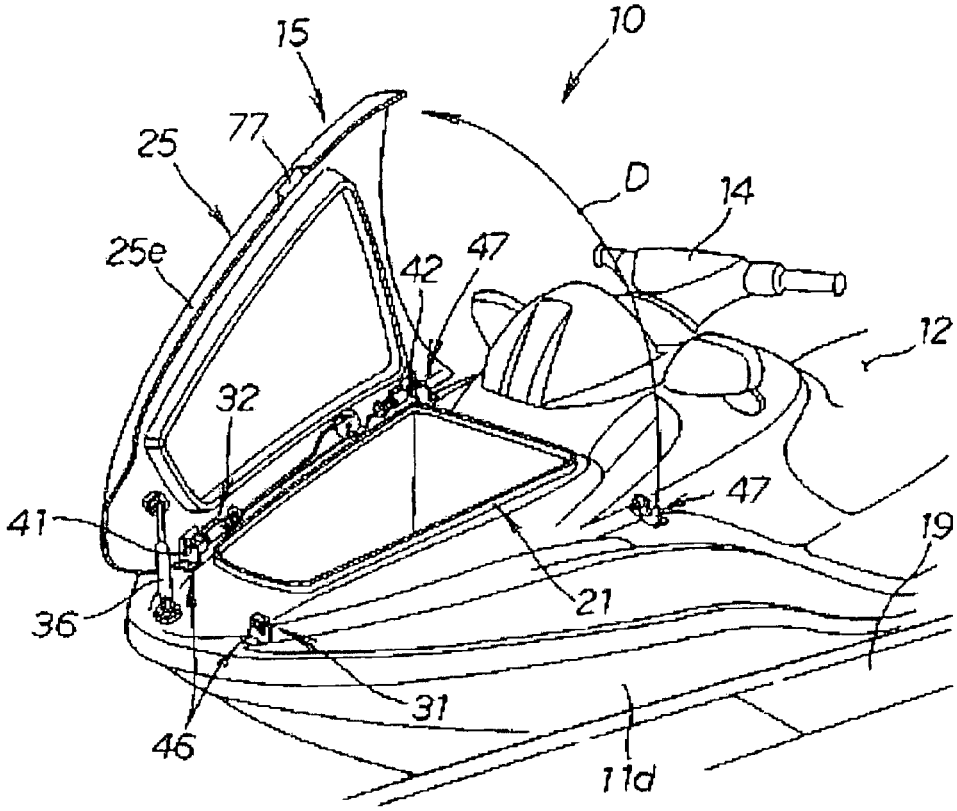
FIG. 9 is a view explaining a state in which the lid according to the first embodiment is laterally opened from the left side.

FIG. 9 is a view explaining a state in which the lid according to the first embodiment is laterally opened from the left side.

The lid 25 is opened laterally about the front and rear pins 41, 43 of the right hinge 32, as indicated by the arrow D.

The left side portion 25*e* of the lid 25 can be easily operated because the handle 77 is positioned in the vicinity of the quay 19.

Moreover, the lid 25 has a smaller width dimension compared to the linear dimension. For this reason, by opening the lid 25 laterally, the amount of lifting when fully opening the lid 25 can be decreased.

This allows the opening operation of the lid 25 to be carried out easily without spending time and effort.

Moreover, by opening (laterally opening) the lid 25 laterally, the hinge does not need to be provided forward of the opening 22 of the article storing box 21.

This allows the dimension of the opening 22 to be widened, allows a large storage space of the article storing box 21 to be secured, and allows luggage to be easily taken in and out.

In addition, by allowing the lid 25 to be opened and closed in the direction (lateral direction) of a small width, a force acting on the left and right hinges 31, 32 and a lifting force of the lid 25 can be decreased when the lid 25 is opened.

This allows the left and right hinges 31, 32 and the assist mechanism 36 to be reduced in size.

Moreover, with the state in which the small boat 10 is brought alongside the quay 19, the laterally opened lid 25 is disposed at the opposite of the quay 19.

Accordingly, because the lid 25 will not get in the way when taking luggage in and out of the article storing box 21 from the quay 19 side, taking the luggage in and out can be easily carried out.

Here, the lid 25 can be opened from the left or right side of the hull 11. Accordingly, even when the right side portion 11*c* of the small boat 10 comes alongside the quay, the right side of the lid 25 can be opened in the same way as when the left side portion 11*d* of the small boat 10 comes alongside the quay.

Upon completion of taking luggage in and out, the lid 25 is closed. The left side portion 25*e* of the lid 25 is lowered toward the left side portion 11*d* of the hull 11.

The front pin 41 (see FIG. 7(*b*)) of the left side portion 11*d* moves toward the front supporting member 46, and at the same time the rear pin 43 (see FIG. 7(*b*)) of the left side portion 11*d* moves toward the rear supporting member 47.

Figure 10C:
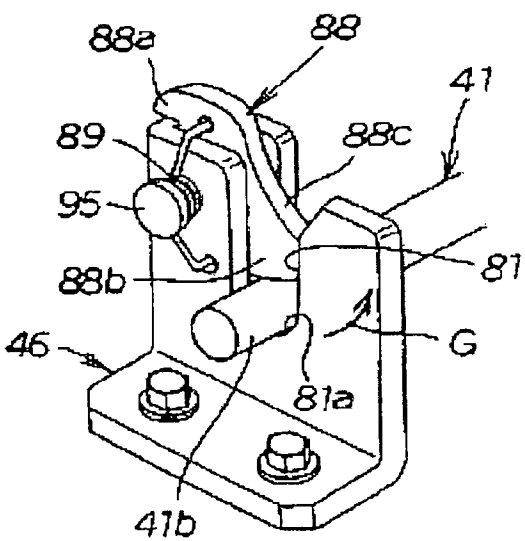
FIGS. 10(*a*) to 10(*c*) are views explaining an example in which a front pin according to the first embodiment engages with a front supporting member.
Figure 10B:
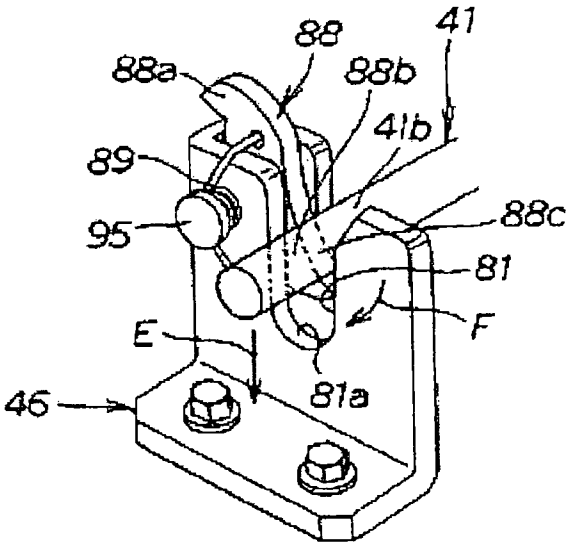
Figure 10A:
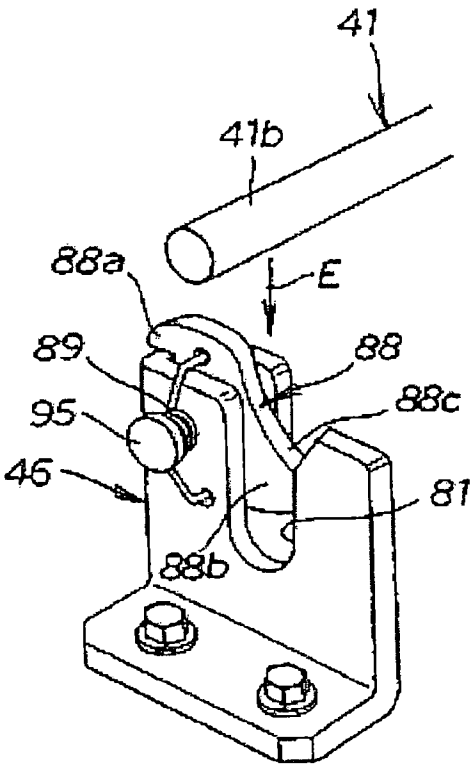

FIGS. 10(*a*) to 10(*c*) are views explaining an example in which the front pin according to the first embodiment engages with the front supporting member.

In FIG. 10(*a*), the tip part 41*b* of the front pin 41 descends toward the front engagement groove 81 of the front supporting member 46 as indicated by the arrow E.

In FIG. 10(*b*), the tip part 41*b* of the front pin 41 enters the front engagement groove 81 to press the upper side 88*c* of the claw part 88*b* with the tip part 41*b* of the front pin 41.

The lock piece 88 swings against a spring force of the spring member 89 as indicated by the arrow F. The tip part 41*b* of the front pin 41 descends along the front engagement groove 81.

In FIG. 10(*c*), when the tip part 41*b* of the front pin 41 reaches the bottom 81*a* of the front engagement groove 81, the claw part 88*b* will disengage from the tip part 41*b* of the front pin 41.

The lock piece 88 rotates by a spring force of the spring member 89 as indicated by the arrow G. The projecting piece 88*a* of the lock piece 88 is in contact with the bent piece 93 to hold the lock piece 88 in the locked position.

The claw part 88*b* of the lock piece 88 plugs the opening of the front engagement groove 81, and the tip part 41*b* of the front pin 41 is rotatably engaged (connected) with the front engagement groove 81.

The tip part 43*b* of the rear pin 43 is also rotatably engaged (connected) with the rear supporting member 47 in the same manner as the tip part 41*b* of the front pin 41.

This allows the lid 25 to be held in a closed state.

In the article storing structure 15 of a small boat according to the first embodiment, the lid 25 can be opened and closed to both sides (left and right sides) by using the left and right hinges 31, 32 also as a part of the left and right lock members 33, 34. However, in an alternative embodiment of the first embodiment, the lid 25 is constructed so as to be opened and closed freely only to one side (i.e., right side or left side).

In the alternative embodiment of the first embodiment, one of the left and right hinges 31, 32 is a dedicated component used for the hinge, and the other one of the left and right hinges 31, 32 is a dedicated component used for the lock member.

In other words, the alternative embodiment of the first embodiment includes a hinge (one of the left and right hinges 31, 32) which is provided at one end portion (i.e., at one side of the right side portion 25*d* and the left side portion 25*e*) in the crosswise direction of the lid 25, and which supports the lid 25 so as to be freely opened and closed. A lock member (the other one of the left and right lock members 33, 34) is provided at the other end portion (i.e., the other end of the right side portion 25*d* and the left side portion 25*e*) in the crosswise direction of the lid 25 for allowing for the connection and disconnection of the lid 25.

By releasing the lid 25 in the engaged condition with the other lock member, the lid 25 can be opened and closed laterally about one of the hinges.

According to the alternative embodiment of the first embodiment, the same effect as that of the first embodiment can be obtained. In addition, according to the alternative embodiment of the first embodiment, by setting one of the left and right hinges 31, 32 to be a dedicated component, the one hinge can be provided in a place (e.g., at a corner of the lid 25) optimum for the hinge to serve as a hinge.

This allows the lid 25 to be supported more comfortably with the one hinge, so that the rigidity of the lid 25 can be improved further when opening the lid 25.

Next, second and third embodiments will be described in accordance with FIGS. 11 to 14. Note that, in the second and third embodiments, the descriptions will be omitted by giving the same reference numerals to the same or similar members as those of the article storing structure 15 of the first embodiment.

Figure 11:
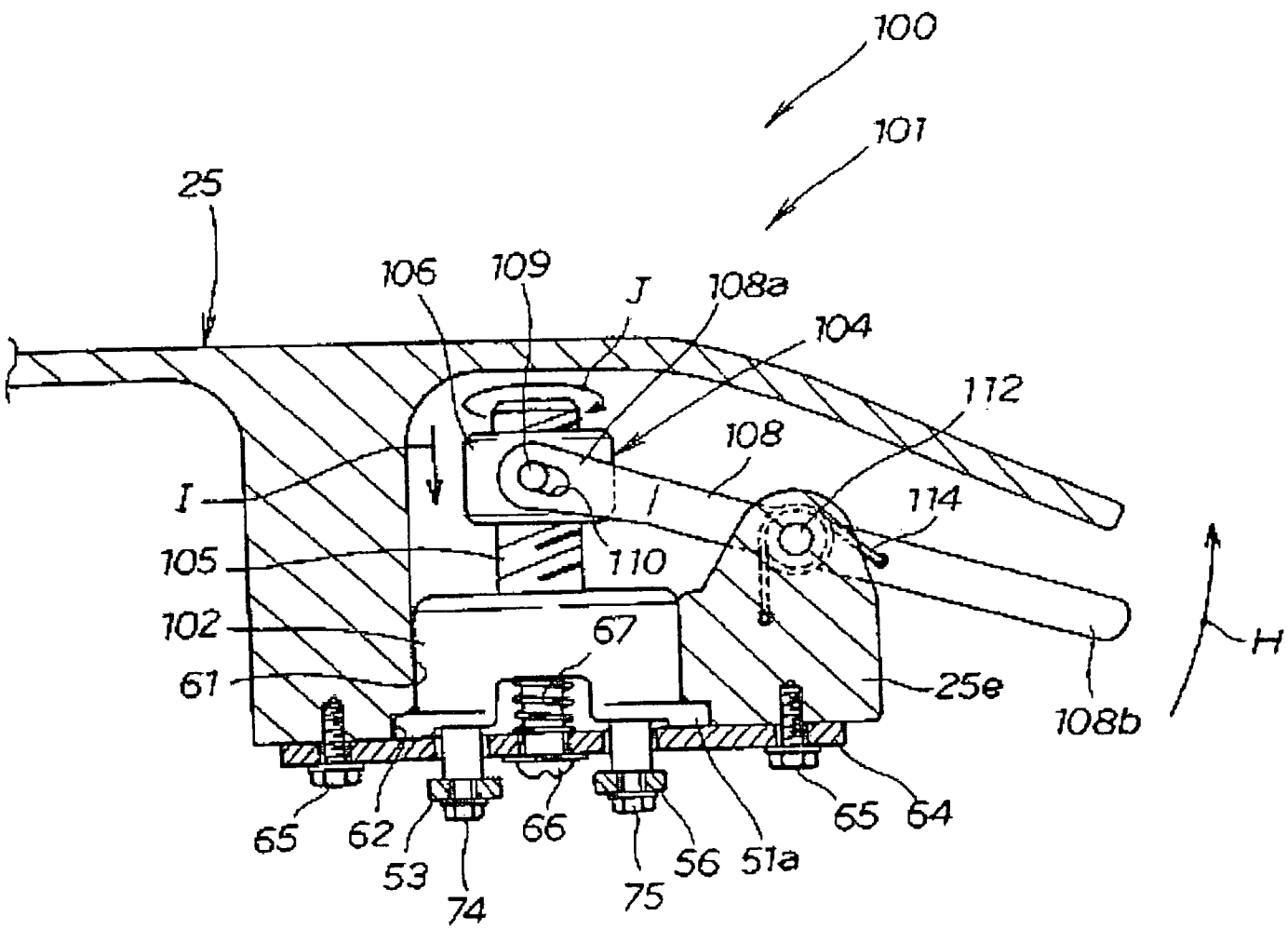
FIG. 11 is a cross sectional view showing a left side lock member of an article storing structure (a second embodiment) of a small boat according to the present invention.

FIG. 11 is a cross-sectional view showing a left lock member of an article storing structure (the second embodiment) of a small boat according to the present invention.

In an article storing structure 100 of a small boat, an operating part 102 of a left lock member 101 differs from the operating part 51 of the first embodiment, and the other structure is the same as that of the first embodiment.

The operating part 102 is made by removing the gripping part 51*b* from the operating part 51 of the first embodiment (see FIG. 4), and the other structure is the same as that of the operating part 51 of the first embodiment.

A ball screw 104 is provided at the top of the operating part 102.

For the ball screw 104, a screw axis 105 is set on the top of the operating part 102, and a nut 106 is attached to the screw axis 105 via a ball (not shown) so that the nut 106 can be moved up and down freely.

A tip part 108*a* of an operating lever 108 is rotatably connected to the nut 106 via a pin 109.

More specifically, a long hole 110 is formed in the tip part 108*a*, and the pin 109 is inserted in the long hole 110. Accordingly, the tip part 108*a* is rotatably connected to the nut 106 via the pin 109.

Then, an approximately center portion of the operating lever 108 is rotatably attached to the left side portion 25*e* of the lid 25 via a support pin 112.

With the operating part 102, by lifting a base end 108*b* of the operating lever 108 as indicated by the arrow H, the nut 106 descends as indicated by the arrow I.

Due to the descending of the nut 106, the screw axis 105 rotates as indicated by the arrow J.

Due to the rotation of the screw axis 105, the operating part 102 rotates from a locked position to an unlocked position.

Due to the rotation of the operating part 102, the front and rear pins 41, 43 (see FIG. 5) are moved toward the operating part 102 via the front and rear connecting rods 53, 56.

Due to the movement of the front and rear pins 41, 43, the front pin 41 disengages from the front supporting member 46, and the rear pin 43 disengages from the rear supporting member 47.

Accordingly, by lifting the base end 108*b* of the operating lever 108 continuously, the left side portion 25*e* of the lid 25 can be lifted to open the lid 25 laterally.

On the other hand, by releasing the operating force of the base end 108*b* of the operating lever 108, the operating lever 108 is returned to the state before the operation by a spring force of a return spring 114.

At the same time, the operating part 102 is returned from the unlocked position to the locked position by a spring force of the return spring 67.

Because the operating part 102 returns to the locked position, the front pin 41 moves toward the front supporting member 46 by a spring force of the front compression spring 55 shown in FIG. 5, and the rear pin 43 moves toward the rear supporting member 47 by a spring force of the rear compression spring 58.

As described above, according to the article storing structure 100 of the second embodiment, the same effect as that of the article storing structure 15 of the first embodiment can be obtained.

In addition, according to the article storing structure 100 of the second embodiment, just by lifting the base end 108*b* of the operating lever 108, the lock of the left lock member 33 is released and the left side portion 25*e* of the lid 25 is lifted.

This allows the lid 25 to be opened laterally more easily.

Moreover, it is also possible to construct the lid 25 so as to be freely opened and closed only to one side (i.e., right side or left side) like in the alternative embodiment of the first embodiment.

By constructing the lid 25 as to be freely opened and closed only to one side (i.e., right side or left side), the same effect as that of the alternative embodiment of the first embodiment can be obtained.

Figure 12:
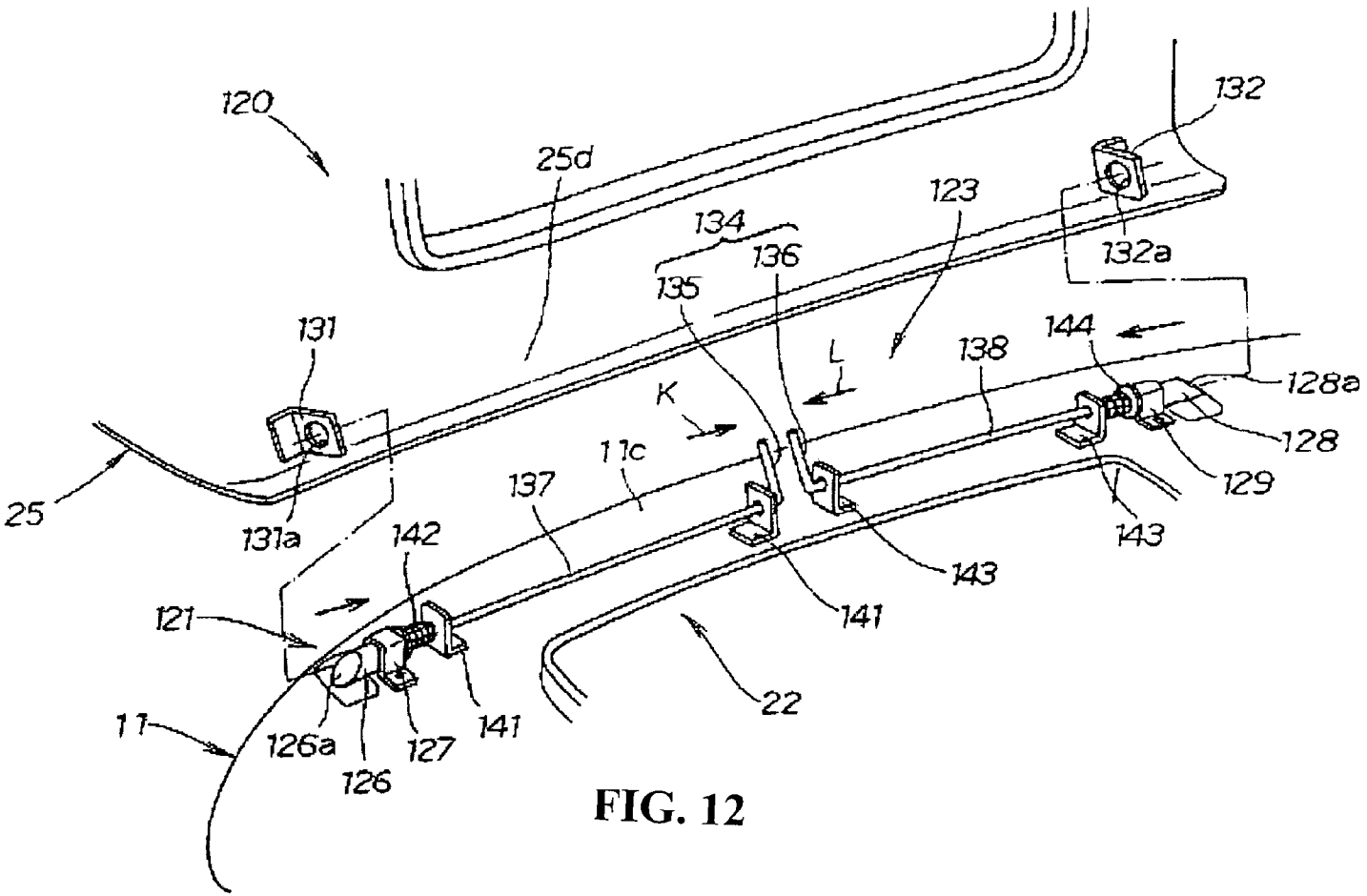
FIG. 12 is an exploded perspective view showing a right hinge part and a right lock member of an article storing structure (a third embodiment) of a small boat according to the present invention.
Figure 13:
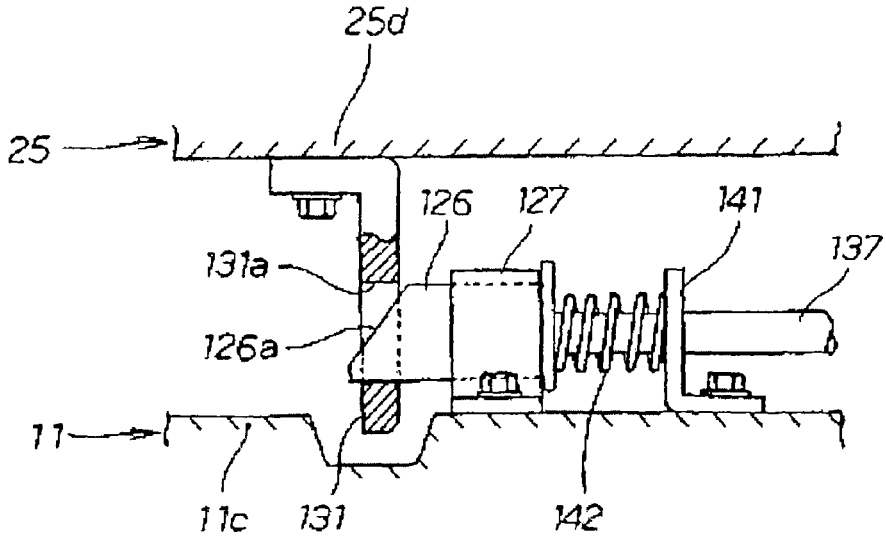
FIG. 13 is a cross sectional view showing a right hinge part of the third embodiment.

FIG. 12 is an exploded perspective view showing a right hinge part and a right lock member of an article storing structure (third embodiment) of a small boat according to the present invention FIG. 13 is a cross-sectional view showing the right hinge part of the third embodiment.

In an article storing structure 120 of a small boat, left and right hinges 121 (only the right hinge 121 is illustrated) and left and right lock members 123 (only the right lock member 123 is illustrated) differ from the first embodiment, but the other structure is the same as that of the first embodiment.

The left and right hinges 121 constitute a pair of hinges, and the left and right lock members 123 constitute a pair of lock members.

Note that because the left and right hinges 121 are bilaterally symmetrical members, respectively, the description on the left hinge will be omitted, and that only the description on the right hinge will be given.

Moreover, because left and right lock members 123 are bilaterally symmetrical members, respectively, the description on the left hinge will be omitted, and that only the description on the right hinge will be given.

For the right hinge 121, in the right side portion 11*c* of the hull 11, a front pin (pin) 126 is provided forward of the opening 22 with a front mounting member 127, and a rear pin (pin) 128 is provided at the back of the opening 22 with a rear mounting member 129. In the right side portion 25*d* of the lid 25, a front supporting member (supporting member) 131 is provided in the back surface, and a rear supporting member (supporting member) 132 is provided in the back surface.

By inserting the front pin 126 into a support hole 131*a* of the front supporting member 131, the front pin 126 is rotatably supported by the front supporting member 131 (see FIG. 13).

By inserting the rear pin 128 into a support hole 132*a* of the rear supporting member 132, the rear pin 128 is rotatably supported by the rear supporting member 132.

Accordingly, the right side portion 25*d* of the lid 25 is connected to the right side portion 11*c* of the hull 11 via the right hinge 121 so as to swing freely.

This allows the lid 25 to be opened and closed laterally about the right hinge 121.

The front pin 126 is disposed in the front-rear direction of the hull 11 and is movably provided in the front-rear direction in the front mounting member 127.

This front pin 126 has a tip part formed in an upward slope 126*a*.

The rear pin 128 is disposed in the front-rear direction of the hull 11 and is provided movably in the front-rear direction in a rear mounting member 129.

This rear pin 128 has a tip part formed in an upward slope 128*a*.

The right lock member 123 includes an operating part 134 provided in the right side portion 11*c* of the lid 11 and between the front and rear pins 126, 128, a front connecting rod 137 for connecting the front pin 126 to a front operating lever 135 of the operating part 134, front and rear supporting brackets 141, 141 for supporting the front connecting rod 137, a front compression spring 142 for holding the front pin 126 in the hinge position, a rear connecting rod 138 for connecting the rear pin 128 to a rear control lever 136 of the operating part 134, front and rear supporting brackets 143, 143 for supporting the rear connecting rod 138 and a rear compression spring 144 for holding the rear pin 128 in the hinge position.

The operating part 134 includes the front operating lever 135 and the rear operating lever 136.

The operating part 134 is a member that is rotatably provided in the right side portion 25*d* of the lid 25. The operating part 134 operates the front pin 126 so as to be freely engaged and disengaged with the front supporting member 131, and operates the rear pin 128 so as to be freely engaged and disengaged with the rear supporting member 132.

More specifically, the front operation lever 135 is operated as indicated by the arrow K, and at the same time the rear operating lever 136 is moved as indicated by the arrow L. Accordingly, the front and rear pins 126, 128 are moved toward the operating part 134 via the front and rear connecting rods 137, 138 as indicated by the arrow.

Due to the movement of the front and rear pins 126, 128 as indicated by the arrow, the front pin 126 disengages from the front supporting member 131, and at the same time the rear pin 128 disengages from the rear supporting member 132.

This allows the right side portion 25*d* of the lid 25 to be lifted upwardly, so that the lid 25 can be opened laterally.

On the other hand, by releasing the operating force of the operating part 134, the front pin 126 moves toward the front supporting member 131 by a spring force of the front compression spring 142, and at the same time the rear pin 128 moves toward the rear supporting member 132 by a spring force of the rear compression spring 144.

Due to the movement of the front pin 126 toward the front supporting member 131, the front pin 126 engages (connects) with the front supporting member 131 as shown in FIG. 13. Moreover, due to the movement of the rear pin 128 toward the rear supporting member 132, the rear pin 128 engages (connects) with the rear supporting member 132.

Accordingly, the right side portion 25*d* of the lid 25 can be supported in the right side portion 11*c* of the hull 11 via the right hinge 121 so as to swing freely.

Figure 14A:
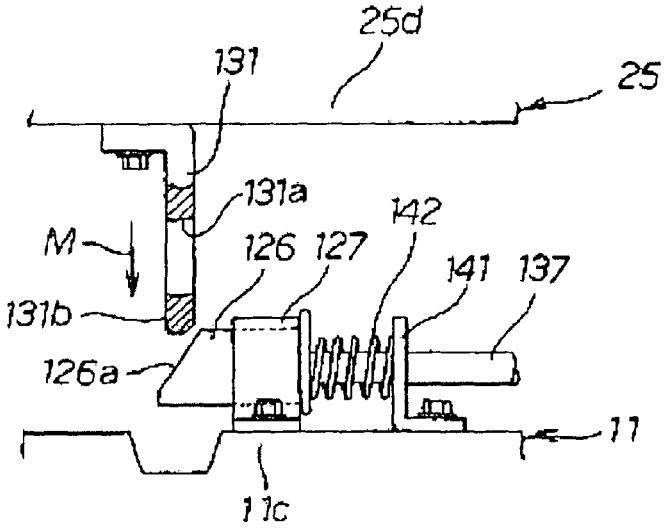
FIGS. 14(*a*) to 14(*c*) are views explaining an example in which a front pin according to the third embodiment engages with a front supporting member.
Figure 14B:
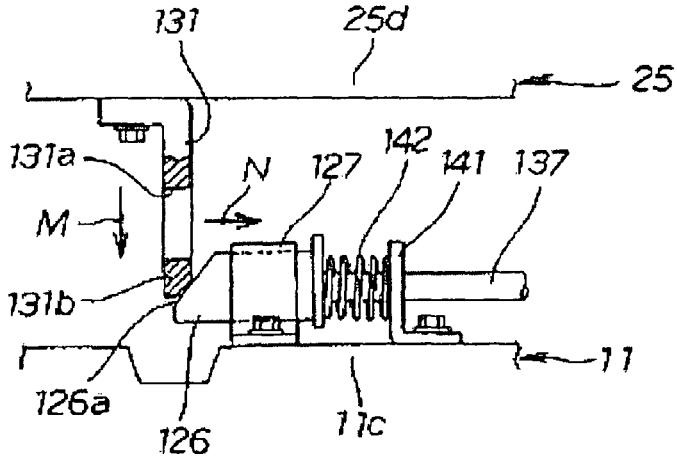
Figure 14C:
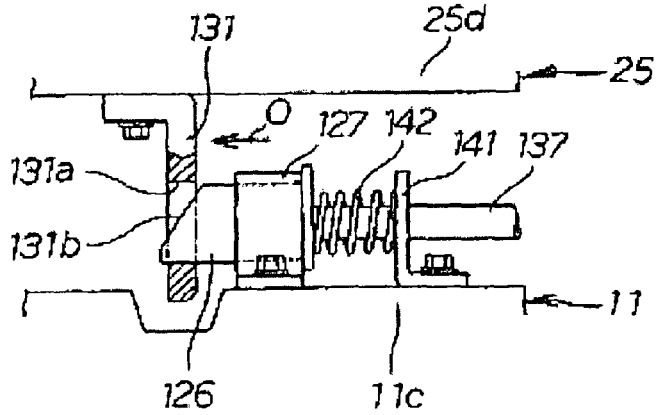

FIGS. 14(*a*) to 14(*c*) are views explaining an example in which the front pin engages with the front supporting member according to the third embodiment.

In FIG. 14(*a*), the right side portion 25*d* of the lid 25 descends toward the right side portion 11*c* of the hull 11. The front supporting member 131 descends toward the slope 126*a* of the front pin 126 as indicated by the arrow M.

In FIG. 14(*b*), a lower end portion 131*b* of the front supporting member 131 is in contact with the slope 126*a* of the front pin 126. Due to the continuous descending of the front supporting member 131 as indicated by the arrow M, the front pin 126 moves against a spring force of the front compression spring 142 as indicated by the arrow N.

In FIG. 14(*c*), the right side portion 25*d* of the lid 25 reaches a closed position (position in which the lid 25 is closed). The front pin 126 faces toward the support hole 131*a* of the front supporting member 131, and the front pin 126 moves toward the support hole 131*a* by a spring force of the front the compression spring 142 as indicated by the arrow O (alphabet capital "O").

The front pin 126 is inserted into the support hole 131*a*, so that the front pin 126 is rotatably engaged (connected) with the front supporting member 131.

The rear pin 128 is rotatably engaged (connected) with the rear supporting member 132 in the same manner as the front pin 126.

This allows the lid 25 to be held in the closed state.

As described above, according to the article storing structure 120 of the third embodiment, the same effect as that of the article storing structure 15 of the first embodiment can be obtained.

In addition, according to the article storing structure 120 of the third embodiment, a simple structure can be made by constituting the operating part 134 of the front and rear operating levers 135, 136.

Moreover, it is also possible to construct the lid 25 as to be freely opened and closed only to one side (i.e., right side or left side) as in the alternative embodiment of the first embodiment.

By constructing the lid 25 so as to be freely opened and closed only to one side (i.e., right side or left side), the same effect as that of the alternative embodiment of the first embodiment can be obtained.

Note that the shape or structure for the article storing box 21, the left hinge 31, the right hinges 32, 121, the left lock members 33, 101, the right lock members 34, 123 and the like illustrated in the embodiments described above are not limited to the illustrated ones, but can be modified arbitrarily.

The article storing structure of the present invention is suitably applied to a small boat which includes an article storing box for storing luggage in the hull and a lid covering the opening of this article storing box from above.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An article storing structure for a small boat comprising:

an article storing box for storing luggage, the article storing box having left and right sides opposite to each other;

a lid covering an opening of the article storing box from above;

a left side hinge provided at a left side of the lid, for supporting the lid so that the lid is openable and closable at the right side of the article storing box;

a right side hinge provided at a right side of the lid, for supporting the lid so as to be that the lid is openable and closable at the left side of the article storing box; and a left side lock member provided at the left side of the lid, which is capable of releasing the left side hinge from an engaged condition at the left side of the article storing box;

a right side lock member provided at the right side of the lid, which is capable of releasing the right side hinge from the engaged condition at the right side of the article storing box, wherein the lid is constructed so that the lid is openable and closable at the left side of the article storing box by releasing the left side hinge from the engaged condition by the left side lock member, and wherein the lid is constructed so that the lid is openable and closable at the right side of the article storing box by releasing the right side hinge from the engaged condition by the right side lock member, wherein each of the left and right side hinges includes a first pin and a second pin provided on the lid, further comprising:

first and second support members provided at each of the left and right sides of the article storing box, the first and second pins being pivotable with respect to the corresponding first and second support members, wherein each of the left and right lock members includes a single operating part which is operatively connected to the first pin and the second pin of the corresponding hinge, the single operating part being selectively rotatable to move the first pin and the second pin of the corresponding hinge to an extended state in a locked position, and being selectively rotatable to move the first pin and second pin to a retracted state in an unlocked position.

2. The article storing structure for a small boat as recited in claim 1, wherein by operating the first and second pins and the first and second support members of one of the left and right side hinges into a disengaged state by the corresponding operating part, the lid can swing about the other of the left and right side hinges.

3. The article storing structure for a small boat as recited in claim 1, wherein the operating part is provided at the left and right sides of the lid, respectively;

wherein the left side hinge is operated so that the left side hinge is engagable and disengagable by the left side operating part; and the right side hinge is operated so that the right side hinge is engagable and disengagable by the right side operating part.

4. The article storing structure for a small boat as recited in claim 1, wherein the lid is openable by pivoting the first pin and the second pin of one of the left and right side hinges about the corresponding first and second support members, while the first pin and the second pin of the other of the left and right side hinges is disengaged from the corresponding first and second support members.

5. The article storing structure for a small boat as recited in claim 4, wherein when the left side lock member is operatively connected to said left side hinge and the first pin and the second pin of the left side hinge are retained in the extended state, the left side lock member is in the locked position, and when the right side lock member is operatively connected to said right side hinge and the first pin and the second pin of the right side hinge are retained in the extended state, the right side lock member is in the locked position.

6. The article storing structure for a small boat as recited in claim 4, wherein when the left side lock member is operatively connected to said left side hinge and the first pin and the second pin of the left side hinge are moved from the extended state to the retracted state, the left side lock member is in the unlocked position, and when the right side lock member is operatively connected to said right side hinge and the first pin and the second pin of the right side hinge are moved from the extended state to the retracted state, the right side lock member is in the unlocked position.

7. The article storing structure for a small boat as recited in claim 1, wherein the lid is substantially trapezoidal in shape.

8. An article storing structure, comprising:

an article storing box, the article storing box having left and right sides opposite to each other;

a lid having for covering an opening of the article storing box from above;

a left side hinge provided at a left side of the lid, for supporting the lid so that the lid is openable and closable at the right side of the article storing box;

a right side hinge provided at a right side of the lid, for supporting the lid so that the lid is openable and closable at the left side of the article storing box; and a left side lock member provided at the left side of the lid, which is capable of releasing the left side hinge from an engaged condition at the left side of the article storing box;

a right side lock member provided at the right side of the lid, which is capable of releasing the right side hinge from the engaged condition at the right side of the article storing box, wherein the lid is constructed so that the lid is openable and closable at the left side of the article storing box by releasing the left side hinge from the engaged condition by the left side lock member, wherein the lid is constructed so that the lid is openable and closable at the right side of the article storing box by releasing the right side hinge from the engaged condition by the right side lock member, and wherein each of the left and right side hinges includes a first pin and a second pin provided on the lid, and further comprising:

first and second support members provided to each of left and right sides of the article storing box, the first and second pins being pivotable with respect to the corresponding first and second support members, wherein each of the left and right lock members includes a single operating part which is operatively connected to the first pin and the second pin of the corresponding hinge, the single operating part being selectively rotatable to move the first pin and the second pin of the corresponding hinge to an extended state in a locked position, and being selectively rotatable to move the first pin and second pin to a retracted state in an unlocked position.

9. The article storing structure as recited in claim 8, wherein by operating the first and second pins and the first and second support members of one of the left and right side hinges into a disengaged state by the corresponding operating part, the lid can swing about the other of the left and right side hinges.

10. The article storing structure as recited in claim 8, wherein, the operating part is provided at the left and right sides of the lid, respectively;

wherein the left side hinge is operated so that the left side hinge is engagable and disengagable by the left side operating part; and the right side hinge is operated so that the right side hinge is engagable and disengagable by the right side operating part.

11. The article storing structure as recited in claim 8, wherein the lid is openable by pivoting the first pin and the second pin of one of the left and right side hinges about the corresponding first and second support members, while the first pin and the second pin of the other of the left and right side hinges is disengaged from the corresponding first and second support members.

12. The article storing structure as recited in claim 11, wherein when the left side lock member is operatively connected to said left side hinge and the first pin and the second pin of the left side hinge are retained in the extended state, the left side lock member is in the locked position, and when the right side lock member is operatively connected to said right side hinge and the first pin and the second pin of the right side hinge are retained in the extended state, the right side lock member is in the locked position.

13. The article storing structure as recited in claim 11, wherein when the left side lock member is operatively connected to said left side hinge and the first pin and the second pin of the left side hinge are moved from the extended state to the retracted state, the left side lock member is in the unlocked position, and when the right side lock member is operatively connected to said right side hinge and the first pin and the second pin of the right side hinge are moved from the extended state to the retracted state, the right side lock member is in the unlocked position.

14. The article storing structure as recited in claim 13, wherein the lid is substantially trapezoidal in shape.

15. An article storing structure for a small boat, comprising:

an article storing box for storing luggage, the article storing box having left and right sides opposite to each other;

a lid for covering an opening of the article storing box from above;

a left side hinge which is provided along a left side of the lid, for supporting the lid so that the lid is openable and closable at the right side of the article storing box;

a right side hinge which is provided along a right side of the lid, for supporting the lid so that the lid is openable and closable at the left side of the article storing box; and a left side lock member which is provided along the left side of the lid, for allowing a connection and disconnection of the lid at the left side of the article storing box;

a right side lock member which is provided along the right side of the lid, for allowing a connection and disconnection of the lid at the right side of the article storing box;

wherein the lid is constructed so that the lid is openable and closable at the left side of the article storing box by releasing the lid in the engaged condition by the left side lock member, and the lid is constructed so that the lid is openable and closable at the right side of the article storing box by releasing the lid in the engaged condition by the right side lock member, wherein said left side hinge includes a first pin and a second pin for engaging with respective left side support members provided at the left side of the article storing box for enabling the lid to be opened by pivoting the first pin and the second pin of said left side hinge about the left side support members, and said right side hinge includes a first pin and a second pin for engaging with respective right side support members provided at the right side of the article storing box for enabling the lid to be opened by pivoting the first pin and the second pin of said right side hinge about the right side support members, and wherein each of the left and right lock members includes a single operating part which is operatively connected to the first pin and the second pin of the corresponding hinge, the single operating part being selectively rotatable to move the first pin and the second pin of the corresponding hinge to an extended state in a locked position, and being selectively rotatable to move the first pin and second pin to a retracted state in an unlocked position.

16. The article storing structure for a small boat as recited in claim 15, wherein when the first pin and the second pin of the left side hinge are moved away from each other in an axial direction to an extended state, the left side lock member is operatively connected to said left side hinge, the left side lock member is in the locked position; and when the first and second pins of the right side lock member are moved away from each other in the axial direction to the extended state, the right side lock member is in the locked position.

17. The article storing structure for a small boat as recited in claim 15, wherein when the first pin and the second pin of the left side hinge are moved toward each other in an axial direction from the extended state to the retracted state, the left side lock member is in the unlocked when the first pin and the second pin of the right side hinge are moved toward each other in the axial direction from the extended state to the retracted state, the right side lock member is in the unlocked position.

* * * * *